US006887047B2

(12) United States Patent
Grapes

(10) Patent No.: US 6,887,047 B2
(45) Date of Patent: May 3, 2005

(54) PNEUMATIC PINCH MECHANISM FOR A DEFORMABLE TUBE

(75) Inventor: Robert Donald Grapes, Palmerston North (NZ)

(73) Assignee: Precision Dispensing Systems Limited, Palmerton North (NZ)

( * ) Notice: Subject to any disclaimer, the term of this patent is extended or adjusted under 35 U.S.C. 154(b) by 80 days.

(21) Appl. No.: 10/363,293

(22) PCT Filed: Aug. 24, 2001

(86) PCT No.: PCT/NZ01/00172

§ 371 (c)(1),
(2), (4) Date: Feb. 27, 2003

(87) PCT Pub. No.: WO02/18790

PCT Pub. Date: Mar. 7, 2002

(65) Prior Publication Data

US 2004/0009081 A1 Jan. 15, 2004

(30) Foreign Application Priority Data

Aug. 28, 2000 (NZ) ..... 506552
Mar. 1, 2001 (NZ) ..... 510256

(51) Int. Cl.[7] ..... F04B 43/107
(52) U.S. Cl. ..... 417/384; 417/387; 417/478
(58) Field of Search ..... 417/383, 384, 417/385, 386, 389, 394, 478, 479, 480

(56) References Cited

U.S. PATENT DOCUMENTS 2,046,491 A * 7/1936 Lane ..... 417/478
3,427,987 A * 2/1969 Eull ..... 417/394
3,551,076 A * 12/1970 Wilson ..... 417/385
3,859,011 A 1/1975 Hart
3,902,826 A * 9/1975 Nagel et al. ..... 417/386
4,178,133 A 12/1979 Rawicki
4,358,252 A * 11/1982 Hart ..... 417/478
4,474,540 A * 10/1984 Bonastia et al. ..... 417/478

FOREIGN PATENT DOCUMENTS

| | | |
|---|---|---|
| DE | 2343042 | 8/1973 |
| GB | 2195149 | 3/1988 |
| JP | 2000-131115/12 | 1/2000 |
| NL | 9100929 | 12/1992 |
| WO | WO08600962 | 2/1986 |
| WO | WO9514171 | 5/1995 |

* cited by examiner

*Primary Examiner*—Michael Koczo
(74) *Attorney, Agent, or Firm*—Blakely Sokoloff Taylor & Zafman

(57) ABSTRACT

A pinch mechanism, which can be used as part of a pump, includes a deformable tube (10) enclosed within a body (11) which has a first chamber **(11*a*). The deformable tube (10) defines a flow passage. A second chamber (19) is coupled via passage (17) to the first chamber (11*a*). A piston (20) is located within the second chamber (19) and movable between first and second positions. Upon moving to the first position a pressure increase occurs in the first chamber (11*a*). Upon moving to the second position a negative pressure is created in the first chamber (11*a*). A vent means (25) is located at a point during movement of the piston (20) between the first and second positions which enables pressure equalisation within the second chamber (19)** to occur.

17 Claims, 5 Drawing Sheets

PNEUMATIC PINCH MECHANISM FOR A DEFORMABLE TUBE

BACKGROUND OF THE INVENTION

This invention relates to improvements in pinch mechanisms. The invention is particularly suited for elastic rebound pinch mechanisms but is not limited thereto.

Problems exist when moving liquid with conventional pumping methods in which moving parts are exposed to product flow. For example:

- Gears, seals, pistons and springs in contact with the product flow can very quickly succumb to corrosion, become blocked and or generally become in operative or faulty in operation
- When used in an hygienic environment, or where one pump is used for a variety of liquids, these parts can be difficult to clean without disassembly
- In some cases, peristaltic pumps have been used to try and address these issues, but poor tube life is often cited as a significant limiting factor.

Elastic rebound pinch mechanisms are known. The mechanisms can function as a valve or as a pump. Generally the mechanism relies on a flexible tube or conduit having elastic rebound characteristics such that the tube can be pinched to close a flow passage through the tube and then released to enable the elastic rebound to restore the tube to substantially its non-deformed state. An elastic rebound pinch mechanism pump of the type disclosed in WO 99/01687 can overcome many of the above identified problems.

A problem which can arise with pinch mechanisms is that the rebound characteristics of the tube and/or the material from which it is constructed may not be sufficient to restore the tube to its fully non deformed state. Also the speed of movement of the tube to the non-deformed state can be slow. In a pumping situation failure to rebound fully or quickly can impair or at least limit the desired pump characteristics.

Furthermore the nature of the fluid material to be pumped or moved through the tube may require the tube to be made of a material (or of such thickness) that the elastic rebound characteristics do not permit the tube to rebound to its non-deformed state as fully or as quickly as desired. Alternately the material to flow through the tube may be of a viscosity or be sticky in nature such that once again the desired elastic rebound characteristics of the tube are impaired.

SUMMARY OF THE INVENTION

It is an object of the present invention to provide an improved pinch mechanism in which the pinch mechanism exhibits favourable restoring characteristics of a deformable tube.

Broadly in one aspect of the invention there is provided a pinch mechanism including a deformable tube enclosed within a first chamber, the deformable tube defining a flow passage, a second chamber coupled to said first chamber, a piston located within the second chamber, the piston being movable between first and second positions such that upon moving to said first position a pressure increase occurs in said first chamber and upon moving to said second position a negative pressure is established in said first chamber and vent means, which at a point during movement of the piston between the first and second positions enables a pressure equalisation within the second chamber occur.

According to one form of the invention the deformable tube is resilient and exhibits an inherent rebound characteristic such that the tube tends to revert to a substantially non-deformed state.

DESCRIPTION OF THE PREFERRED EMBODIMENTS

Figure 1:
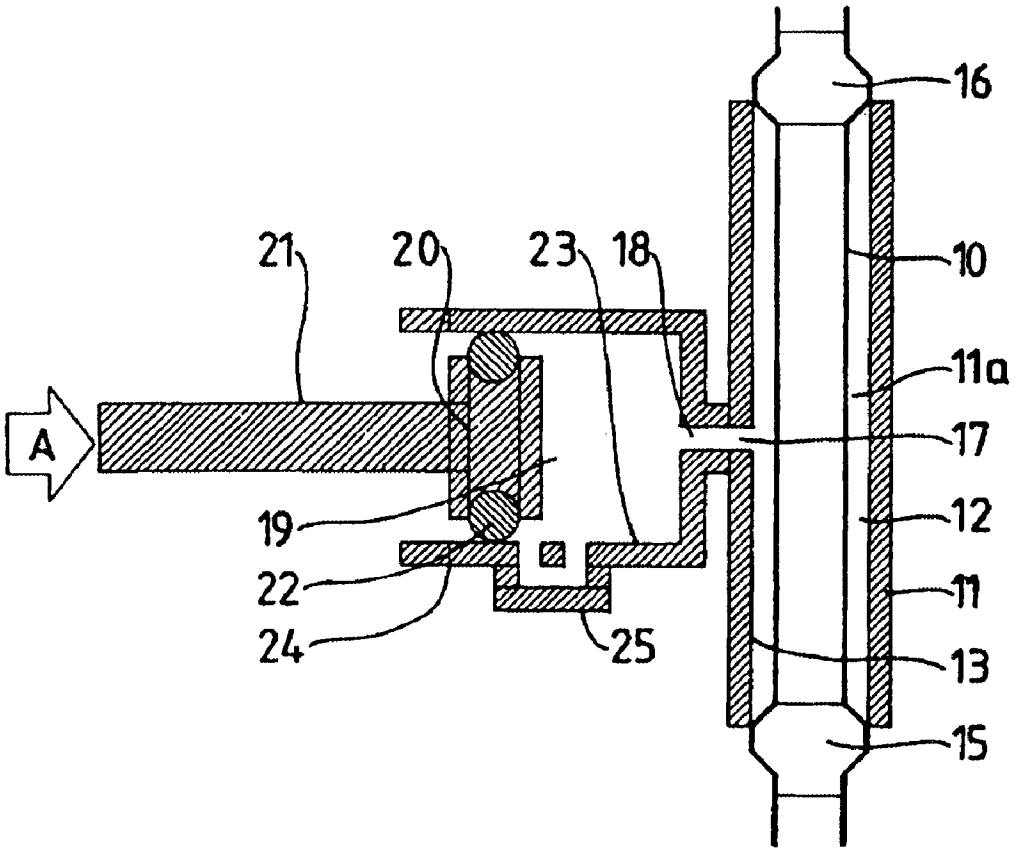
FIG. 1 in schematic form illustrates one embodiment of the invention in the form of a rebound pinch mechanism forming part of a pump.

Referring to FIG. 1 there is shown a flexible tube 10 which is subjected to cyclic compression or pinching of the tube into a closed or partially closed position and released to a substantially non-deformed configuration. The flexible tube 10 is typically a silicone tube.

According to the invention flexible tube 10 is located within a housing 11 which has a cross sectional shape commensurate with that of the exterior wall surface of tube 10. Thus in one preferred form of the invention tube 10 is of circular cross section as is the housing 11. A clearance 12 is provided between the inner wall surface 13 and outer wall surface 14 of the respective housing 11 and tube 10. For the purposes of illustration FIG. 1 exaggerates the extent of clearance 12.

The housing 11 is sealed at each end. In the illustrated form the sealing effect is achieved by the positioning at respective ends an inlet valve 15 and an outlet or exhaust valve 16. In accordance with normal pinch mechanism technology the exhaust valve 16 opens upon the tube 10 being pinched to a closed position. The exhaust valve 16 closes and the inlet valve 15 opens as the tube 10 reverts to its non-deformed state.

Because housing 11 is sealed closed at each end the tube 10 is effectively located within a chamber 11*a*.

According to the present invention a mechanical force contacting the tube is not applied in order to achieve the pinching action. By contrast with known pinch mechanisms the pinching action is preferably achieved pneumatically.

Thus according to the preferred pneumatic form of the invention a port 17 is formed in the wall of the housing 11. Port 17 communicates via passage 18 with a chamber 19 (more particularly a cylinder) in which a piston 20 can reciprocate. A piston rod 21 extends from the piston 20. Rod 21 is coupled to an actuating means such as a motor, linear actuator or the like. Seals 22 associated with piston 20 slidingly engage with the inner wall surface 23 of the chamber housing 24 to provide the required sealing effect.

Associated with the housing 24 is a transfer port 25.

As the piston rod 21 moves in the direction of arrow A (see FIG. 1) the piston 20 moves toward transfer passage 18. Once the seals 22 have moved beyond the transfer port 25 air located between the piston 20 and inside of housing 11 is gradually compressed. The compressed air acts on the tube 10 to thus cause the tube to collapse inwardly.

Figure 3:
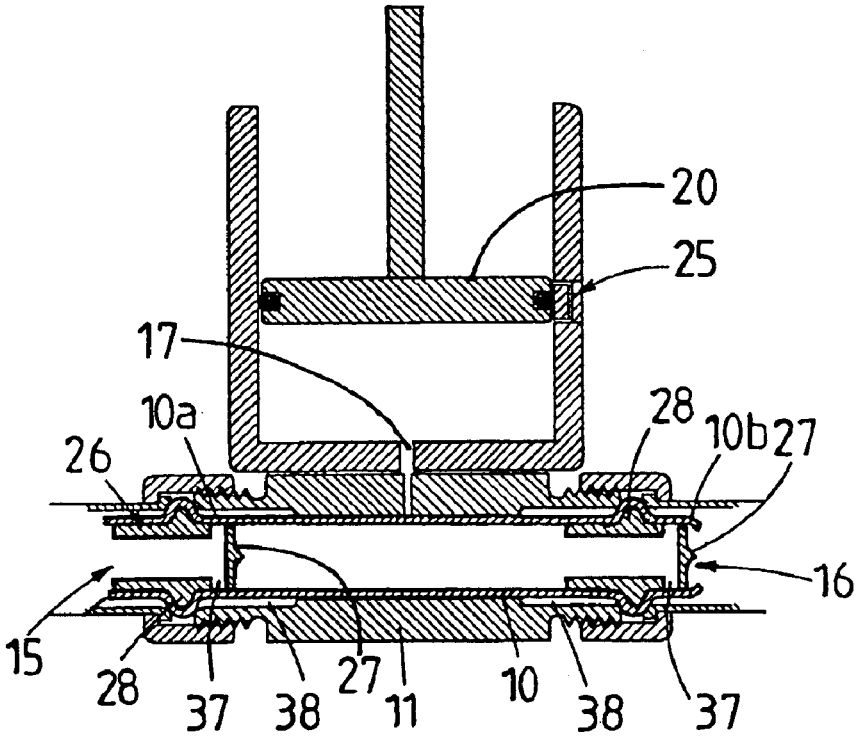
FIGS. 3 to 5 are views of the second embodiment at different operational stages.

In the preferred form of the invention the tube 10 is confined within the encasement of housing 11 therefore tube 10 is confined in the manner disclosed in our patent specification WO099/01687. Thus tube 10 collapses inwardly in an inverted manner into a sealed closed state as illustrated in FIG. 3 of WO99/01687. However, this inverted collapse of the tube is created not by mechanical means as disclosed in WO99/01687 but via the application of pressurised air.

It has been found that the tube 10 will inwardly invert in the vicinity of port 17 but not necessarily directly adjacent port 17. The tube will tend to inwardly invert at the point of least resistance to inversion.

When the piston 20 retracts the pressure dissipates. As the piston 20 crosses the transfer port 25 pressure in the chamber 19 will be equalized to atmospheric pressure. This occurs because chamber 19 vents via port 25 to atmosphere, the reverse side of piston 20 being exposed to atmosphere.

As the piston retracts further transfer port 25 will close and a negative pressure will develop within the chamber 19 and hence within chamber 11*a* in the housing 11. This negative pressure creates a sucking effect on the tube 10 and causes it to revert to its normal state. Then as the piston rod 21 once again moves in the direction of arrow A the negative pressure is dissipated and equalised to atmospheric pressure as the transfer port 25 is once again opened.

Such negative pressure applied to the tube 10 can actually cause the tube 10 to expand beyond its normal state. Therefore not only does the application of a negative pressure on the tube aid in it reverting to its non-deformed state it can also further assist the efficiency of the pinch mechanism when used in a pump application.

The throughput of the pinch mechanism when used in a pump configuration can be adjusted by the speed and/or stroke of piston 20. Tests to date show that a pump according to the present invention can be kept dimensionally compact. Hence the pump can be more compact than a conventional pinch mechanism pump where the pinching action relies on the application of mechanical force to pinch the tube closed and reliance on the rebound characteristics of the tube for the tube to return to its "open" state.

The invention is open to modification. For example the piston mechanism can be located remote from the housing and coupled by say a tube between transfer passage 18 and port 17. This may be advantageous when the pump operates as say an immersion pump.

The embodiment of the invention shown in FIG. 1 demonstrates some excellent attributes such as:

- No moving parts in contact with the liquid flow.
- A clear unobstructed product flow providing excelling hygiene properties making cleaning simple.
- The pump occupying a small physical space.
- A wide range of motive power possibilities for the pump including small and large electric motors, battery, air, vacuum, water or hand operation.
- Pump sizing being scalable to provide a wide range of volume capabilities.
- Simple or complex electronics being incorporated to control the pump operation including dispense volumes and times.

However, when seeking pumping solutions for a wider range of applications some limitations can arise. These can be characterised as follows.

- The pump can in some applications display restrictive lift capabilities due to limitations arising from the tube rebound properties and/or the tensions required for springs etc. in the inlet valve.
- Dependency on tube rebound properties can limit potential applications of the pump in terms of viscous fluids and chemical compatibility.
- Siphoning can still possibly occur through the pump where suction (vacuum) on the outlet is greater than the biasing force used to close the valves.

Figure 2:
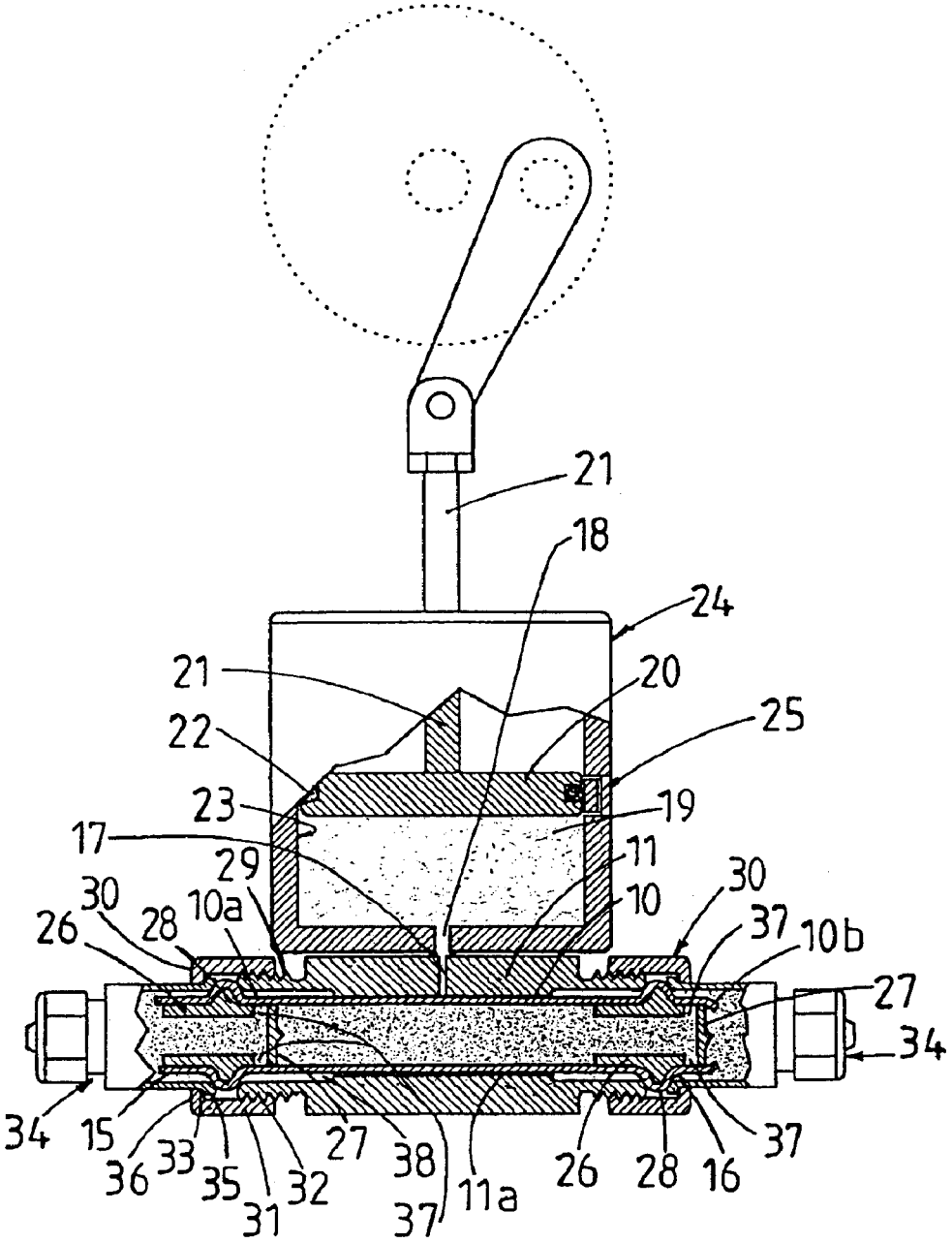
FIG. 2 is, in more detailed form, a cross-sectional drawing of a second embodiment of the invention.

One or more of these limitations can be overcome by the pump arrangement which incorporates the invention and is shown in a second embodiment in FIG. 2.

As with the first embodiment the pump shown in FIG. 2 includes a length of silicone rubber (or equivalent) tube 10 an inlet valve 15 and an exhaust valve 16. Once again valves 15 and 16 are contained in a pressure tight fit with housing 11. In accordance with the first embodiment the operative mechanism is a small air cylinder that can generate positive and negative pressures. The cylinder 24 is connected to the housing 11 via port 17.

As will hereinafter be described, the inlet valve 15 is positioned within the tube 10 with one or more apertures which is/are actually closed by the tube. The exhaust valve 16 is in the preferred form of the invention identical to the inlet valve 15 except that the aperture(s) is/are located external of the housing 11.

FIGS. 2 and 3 show the pump in the "at rest" state. It will be observed that the piston 20 is located at the transfer port 25. The chamber 19 and the chamber 11*a* in housing 11 are thus both at atmospheric pressure.

Figure 6:
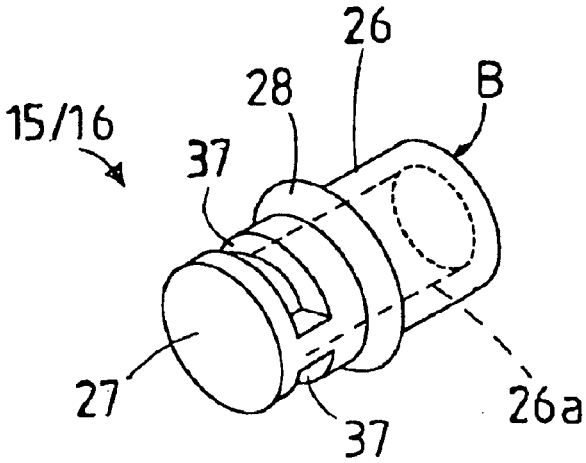
FIG. 6 is a more detailed illustration of the valve unit employed in the second embodiment.

FIGS. 2 and 6 show a valve body B which with the tube 10 forms each of inlet valve 15 and exhaust valve 16. The valve body B comprises a tubular body 26 with a bore 26*a*. The tubular body 26 is closed at one end by a wall 27 preferably formed integrally with body 26. A peripheral outwardly projecting rib 28 extends from the body 26.

The tubular body 26 is inserted into the tube 10. In the case of the inlet valve 15 the body 26 is inserted in the tube so that wall 27 thereof is inboard of the end of the tube 10. The exhaust valve 16 is formed by body 26 inserted so that the end wall 27 is located outside the chamber 11*a* formed in housing 11.

As show in FIG. 2 an external screw thread 29 is applied to each end of the housing 11. An end cap 30 is coupled to each end of the housing 11. The end cap 30 has an annular wall 31 with an internal screw thread 32 to facilitate this coupling.

A concentric opening 33 is formed in the end cap 30. Extending through this opening 33 is a fitting 34. This fitting has a peripheral rim 35 at one end so that it engages not only with the underside of the top 36 of the cap 30 but also the tube 10 where the tube extends over the peripheral rib 28. Thus by screwing on the end cap 30 not only is the fitting 34 attached but also the valve body 26 is located firmly in position so that it cannot move axially relative to the tube 10. Equally the tube 10 is also anchored into position so that it is held in a correct position within the housing 11.

In use appropriate conduits will be coupled to the pump via fittings 34.

Located adjacent end wall 27 of each valve body 26 is a plurality of radial ports 37.

The tube 10 where it fits over valve body 26 thus actually forms a part of the valve mechanism. Hence an extremely simple yet effective valve is formed. In the "at rest" state of the pump the tube 10 forms a seal over the ports 37 of the inlet valve 15. This is shown in FIGS. 2 and 3.

Figure 4:
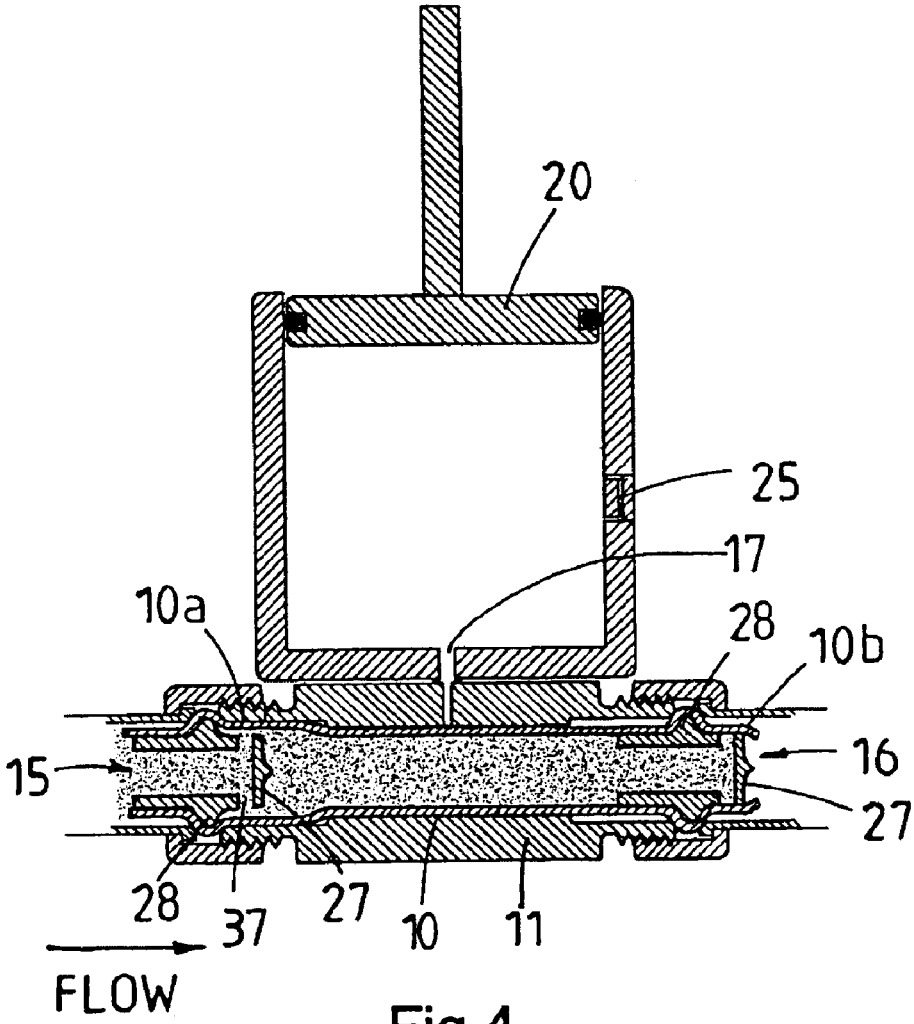

FIG. 4, shows that when a negative pressure is applied to the chamber 11*a* in housing 11 tube 10 is caused to expand and this expansion lifts the portion 10*a* of tube 10 off the outer wall surface of the body 26 adjacent the end wall 27 thereby opening the port(s) 37. This allows liquid from an input conduit (not shown) fixed to the inlet fitting 34 to flow into and fill the tube 10. Outflow from the tube 10 is prevented due to the sealing effect of portion 10*b* of the tube 10 over the outlet port(s) 37 of the valve body 26 of exhaust valve 16.

Figure 5:
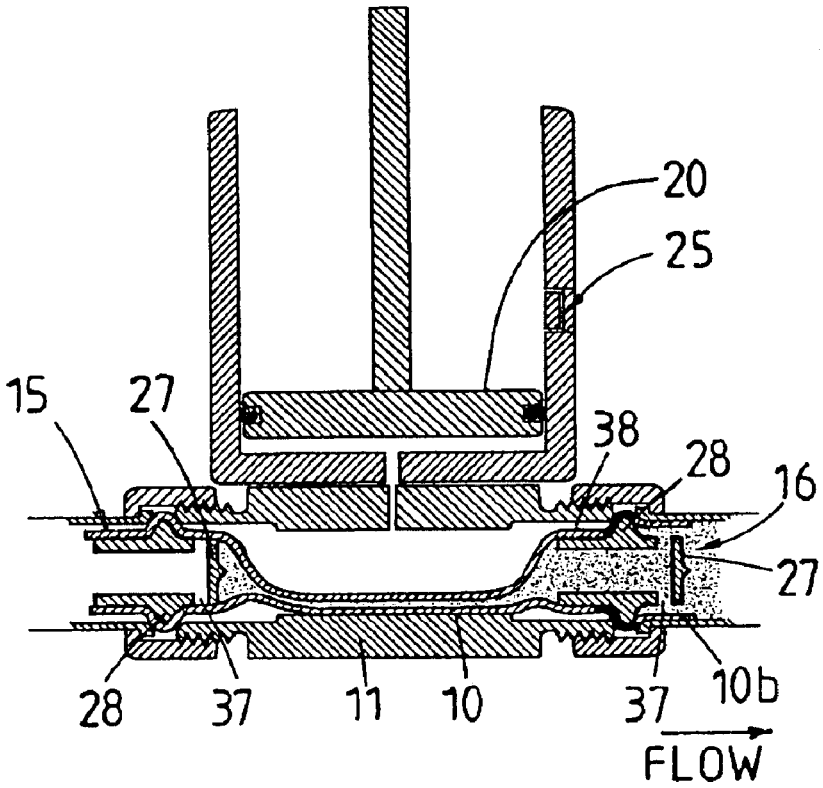

When the air cylinder pressure increases by movement of the piston 20 toward the transfer passageway 18, the tube 10 is forced to collapse inward (see FIG. 5) thereby increasing the pressure of liquid in the tube which forces the portion 10*b* of tube 10 to move off the port(s) 37 of the body B of exhaust valve 16. Fluid thus flows through the exhaust valve 16 and into an outlet conduit (not shown) attached to the outlet fitting 34. This pressure increase in the chamber 11*a* in housing 11 on the other hand causes the tube portion 10*a* where it fits over body 26 of inlet valve 15 in the vicinity of port(s) 37 to maintain a good seal over the port(s) 37 of the inlet valve 15.

FIG. 3 shows a chamber or clearance 38 formed in the wall of housing 11 by a counterboring within housing 11 adjacent inlet valve 15. This provides a clearance for the tube 10 to be lifted by the negative pressure build up from the port end of the inlet valve body 26 such that liquid can flow through the ports 37 and into the main body of the tube 10. Chamber 38 is shown occupied by the lifted wall portion 10*a* of tube 10 in FIG. 4.

As the piston 20 retreats along cylinder 24 the tube 10 reverts to its non-deformed state thereby causing the area 10*a* of tube 10 to once again seal over the port(s) 37 of outlet valve 16.

With the pinch mechanism according to the present invention, no rigid pushers or rollers make contact with and pinch the tube. Therefore, significantly longer tube life is achieved.

Also efficient operation is achievable because the mechanism operates with very little friction, consequently motor power efficiency can be extremely high. Indeed, in applications where it may be desirable a battery power source could be used.

It is believed that the gradual build up of pressure acting on the tube 10 and the gradual development of the negative pressure in the chamber also results in less wear and tear on the tube 10. Furthermore the gradual pressure changes (rather than a sudden change of the type typical with known mechanisms of this type) improves flow characteristics within the tube 10 can be achieved.

With known pumps of this type the means of driving the tube in the chamber can involve a compressed pressure source and a vacuum source. Consequently a complex arrangement of valves, control gear and compressors/vacuum pumps is required. Not only does this represent a capital cost in plant but also higher running costs. The present invention thus represents a radical departure by using the piston 20 in cylinder 19 with transfer port 25 to generate the required positive and negative pressures to operate the tube. The overall result is an effective and economic means of driving the pump with reduced maintenance and running costs.

Previous proposals to reduce the capital costs and running costs mentioned above with prior pumps of this type have included a piston in cylinder arrangement charged with a hydraulic fluid. However, such arrangements are prone to leakage thereby resulting in the need to routinely recharge the cylinder. Also leakage into the chamber is possible and if this leakage of hydraulic fluid takes place into the tube then a serious problem exists, especially if the pump is being used in a food or medical situation.

To overcome this latter problem it has been proposed to charge the cylinder with air or other gaseous medium. However, once again leakage can result in a drop off of performance and thus a need to routinely recharge the cylinder.

With the present invention there is no air consumption during operation. Any leakage which does occur (say due to a worn piston seal) is automatically replenished when the piston passes through the zero pressure point i.e. passes the transfer port 25.

From a commercial point of view, the low number of parts making up the pump provides benefits not only at the initial costs but also ongoing costs. Because of the construction and its operation it is believed that maintenance costs can be kept low.

A further factor which contributes to the favourable maintenance characteristics of the pump is in the area of the seal(s) 22 on piston 20. Because the pressure within cylinder 24 is essentially at atmospheric pressure when the seal(s) 22 pass over the ends of transfer port 25 there is little or no tendency for the seal(s) to be pushed into the port. Thus seal 22 is not subjected to damaging contact with the port 25 and hence a long seal life is achieved.

The pump exhibits good characteristics of dry and wet priming. With the second embodiment the effectiveness of the valves will ensure that no siphoning occurs.

With the present invention there is no requirement that tube 10 have rebound characteristics. Indeed tube 10 can be of thin wall construction (e.g. in the nature of a membrane) which exhibits no rebound characteristics. For the food and medical industries the thin wall tube can be made of a suitable grade polyurethane.

Because of its design the pinch mechanism when in a pump configuration develops good suction aided by the negative pressure on the inlet strike. The level of suction can be altered by design. Output pressure can be preset by adjustment to the air cylinder. The output pressure is also limited by the drive pressure ensuring the pump, and the equipment that may be attached, will not overload. A pressure relief switch is therefore not required. Furthermore without heat generation or abrasion dry running can occur without damage.

A problem which often arises with pumps of this type occurs at the inlet valve. The operation of the inlet valve generally relies on the negative pressure in the tube to lift valve element from the valve seat. This requires a pressure differential to occur at the valve and consequently a pressure drop will take place which can have an adverse impact on the flow into the tube.

With the present invention, however, the operation of the inlet valve is actively driven by the negative pressure build up in the chamber. Consequently there is no or little pressure differential across the inlet valve. This active control of the inlet valve also occurs at closure of the valve due to the build up of greater than atmospheric pressure in the chamber.

In the modified form of the invention the port 17 can be located immediately adjacent the inlet valve 15. Consequently the pressure change in the chamber commences in the vicinity of the valve which results in even better active control of the lifting from or sealing on of the tube 10 with the port(s) 37.

It is envisaged that a series of housings and tubes could be located adjacent one another and operated simultaneously from one source of positive pressure followed by the application from the same source or a separate source of a negative pressure. Therefore one driving arrangement could be used to operate a series of tubes 10 within housing 11.

Other modifications, common uses and different arrangements will be apparent to those skilled in the art within the context of the present invention.

What is claimed is:

1. A pinch mechanism including a deformable tube enclosed within a body having a first chamber, the deformable tube defining a flow passage, a second chamber coupled to said first chamber, a piston located within the second chamber, the piston being movable between first and second positions such that upon moving to said first position a pressure increase occurs in said first chamber and upon moving to said second position a sub-atmospheric pressure is established in said first chamber, and vent means which includes a transfer port which at a point in the travel of the piston between the first and second positions couples parts of the second chamber which are separated by the piston to enable the second chamber to vent to a pressure higher than said sub-atmospheric pressure.

2. A pinch mechanism as claimed in claim 1 wherein the deformable tube is resilient and exhibits an inherent rebound characteristic such that it tends to revert to a substantially non-deformed state.

3. A pinch mechanism as claimed in claim 2 wherein the transfer port of the second chamber can vent to atmosphere.

4. A pinch mechanism as claimed in claim 3 wherein the transfer port is formed in a wall of a housing in which the second chamber is located, the transfer port having first and second ends which open to opposite sides of the piston when the piston is at said point in its travel between the first position and second position.

5. A pump including a pinch mechanism as claimed in claim 1, the pump including a drive mechanism to effect reciprocating movement of the piston between said first and second positions, an inlet valve coupled to a first end of the deformable tube and an outlet valve coupled to a second end of the deformable tube.

6. A pump as claimed in claim 5 wherein the deformable tube forms within the first chamber a seal element for the inlet valve.

7. A pump as claimed in claim 6 wherein the inlet valve includes a valve body at least in part located within said first end of the deformable tube, said valve body including a flow passage and at least one port opening from said flow passage, said at least one port being closed by the deformable tube when the inlet valve is in a closed state.

8. A pump as claimed in claim 7 wherein the valve body includes a tubular portion, the internal bore thereof forming said flow passage, the internal bore being closed at one end, said at least one port extending through the tubular portion adjacent the closed end.

9. A pump as claimed in claim 7 wherein the valve body includes an external radially projecting peripheral rib.

10. A pump as claimed in claim 5 wherein the deformable tube forms outside the first chamber a seal element for the outlet valve.

11. A pump as claimed in claim 10 wherein the outlet valve includes an outlet valve body at least in part located within said second end of the deformable tube, said outlet valve body having a flow passage and at least one outlet port being closed by the deformable tube when the outlet valve is in a closed state.

12. A pump as claimed in claim 11 wherein the outlet valve body includes a tubular portion, the internal bore thereof forming said flow passage, the internal bore being closed at one end, said at least one outlet port extending through the tubular portion adjacent the closed end.

13. A pump as claimed in claim 12 wherein the outlet valve body includes an external radially projecting peripheral rib.

14. A pump as claimed in claim 9 wherein the outlet valve body includes an external radially projecting peripheral rib, the deformable tube is engaged at said first end of the deformable tube over the rib of the inlet valve body and at the second end over the rib of the outlet valve body, clamp means clamping each rib and that portion of deformable tube thereover with an open end portion of the first chamber in body.

15. A pump as claimed in claim 14 wherein the clamp means includes a connection fitting.

16. A pump as claimed in claim 6 wherein the body includes a clearance to permit the seal portion of the deformable tube to move from the body.

17. A pump as claimed in claim 3 wherein the second chamber is connected to the body by a conduit.

* * * * *